US011028985B1

(12) United States Patent
Chaimberg

(10) Patent No.: US 11,028,985 B1
(45) Date of Patent: Jun. 8, 2021

(54) SURFACE MOUNTABLE SPOTLIGHT HOUSING

(71) Applicant: GLOBE ELECTRIC COMPANY INC., Montreal (CA)

(72) Inventor: Adam Chaimberg, Hampstead (CA)

(73) Assignee: GLOBE ELECTRIC COMPANY INC., Montreal (CA)

( * ) Notice: Subject to any disclaimer, the term of this patent is extended or adjusted under 35 U.S.C. 154(b) by 0 days.

(21) Appl. No.: 16/873,078

(22) Filed: Jan. 30, 2020

(51) Int. Cl.

| | |
|---|---|
| ***F21S 8/04*** | (2006.01) |
| ***F21S 8/00*** | (2006.01) |
| ***F21V 23/06*** | (2006.01) |
| ***F21V 21/30*** | (2006.01) |
| ***F21W 131/406*** | (2006.01) |
| ***F21Y 115/10*** | (2016.01) |

(52) U.S. Cl.
CPC ..... *F21S 8/043* (2013.01); *F21S 8/03* (2013.01); *F21V 21/30* (2013.01); *F21V 23/06* (2013.01); *F21W 2131/406* (2013.01); *F21Y 2115/10* (2016.08)

(58) Field of Classification Search
None
See application file for complete search history.

(56) References Cited

U.S. PATENT DOCUMENTS

| | | | | |
|---|---|---|---|---|
| 10,072,805 | B2 * | 9/2018 | Bailey | F21S 8/024 |
| 2013/0250579 | A1 * | 9/2013 | Athalye | F21V 21/047 362/296.05 |
| 2013/0265750 | A1 * | 10/2013 | Pickard | F21L 4/02 362/184 |
| 2015/0131296 | A1 * | 5/2015 | O'Brien-Bernini | F21V 31/005 362/310 |

* cited by examiner

*Primary Examiner* — Ashok Patel
(74) *Attorney, Agent, or Firm* — Guy J. Houle; Houle Patent Agency, Inc.

(57) ABSTRACT

A surface mountable spotlight is comprised by a light directing housing having a rear mounting plate. A light emitting source is mounted in the light directing housing for emitting light out of the open end of the housing. The mounting plate has a contour configuration adapted to conceal a mounting opening formed in a support sheet material behind which is located an electrical connection to a power source. An electrical connector is mounted in the rear surface of the rear mounting plate. Retention spring arms are secured to the rear surface of the rear mounting plate which permits for removable attachment of the rear mounting plate against an inner surface of the support sheet material. A junction box is adapted for connection to the power source and to the electrical connector to supply power to the light emitting source which in a preferred embodiment is an LED light source.

16 Claims, 7 Drawing Sheets

SURFACE MOUNTABLE SPOTLIGHT HOUSING

FIELD OF THE INVENTION

The present invention relates to spotlights and more specifically to a trackless spotlight wherein there is no junction box secured to the housing of the spotlight to provide power to the light emitting source contained in the light housing and further wherein the light housing has a rear flat mounting plate which is removably secured to an outer surface of a support sheet material with the junction box which supplies power to the light emitting source being independent of the light housing and disposed behind an inner surface of the support sheet material.

BACKGROUND OF THE INVENTION

Commonly, spotlights are provided as a track lighting fixture wherein a plurality of light sources, each having a power supply connected thereto, are mounted on the track of the light fixture. The track can also be provided with an elongated electrical connector strip to which the power supply support is attached to provide power to the light source of the spotlight. Such track lighting fixtures are bulky and not always pleasing to the eye. It is also known to mount spotlights units recessed in mounting holes formed in a ceiling sheeting material to direct a light beam vertically downwards or at a slight angle when the light support is tilted within the housing. These are popular with halogen bulbs and now replaceable by bulbs fitted with light emitting diodes. These housings are provided with trim ring flanges which rests on the outer surface of the ceiling about the spotlight.

It is known to mount spotlights on ceiling surfaces or other surfaces to direct light beams against a desired target area to be lite or to accent a certain element, such as a painting on a wall, a piece of art on a table or generally to provide light on a designated surface area. In U.S. Pat. No. 4,258,413, there is disclosed a tiltable light fixture similar to a spotlight and resembling a cylinder and projecting form a ceiling surface. The fixture has a rear housing which is secured to an electrical outlet box mounted in the ceiling. The shade portion of the fixture is telescopically attached to a housing and can be tilted when separated from the housing to direct a light beam to a desired location. A similar spotlight fixture is also disclosed in U.S. Pat. No. 9,593,829 and wherein the light emitting housing is not only hinged to its stationary junction box but also rotatable with respect to the stationary junction box. In both patents a junction box projects from the mounted surface.

There exists a need to provide a spotlight structure which does not contain a junction box as part of the spotlight light fixture and which is secured against the outer surface of a support sheet material by a rear flat mounting wall or plate of the light directing housing and which is hardly visible and wherein the junction box is located remotely of the spotlight and concealed behind the support sheet material, such as ceiling gypsum boards or other finishing sheet materials.

SUMMARY OF THE INVENTION

It is a feature of the present invention to provide a surface mountable spotlight which provides the abovementioned need and several other features not known in the prior art.

Another feature of the present invention is to provide a surface mountable spotlight which is flush mounted on the outer surface of support sheet material and wherein the junction box is separate from the light directing housing and connected to a receptacle connector mounted on a rear surface of a rear wall of the housing by means of a power supply connector of the junction box.

Another feature of the present invention is to provide a surface mountable spotlight wherein a light emitting diode light source is mounted within the light directing housing and wherein the driver circuitry to energize the diodes is located in a junction box connected to a power source and having an outlet supply cable with a connector adapted for quick removable connection to an electrical receptacle connector mounted on a rear wall of the light directing housing.

A still further feature of the present invention is to provide a surface mountable spotlight having a flat rear mounting plate having a contour configuration adapted to conceal a small mounting hole provided in a support sheet material and wherein the mounting plate is provided with retention means to removably secure the light directing housing against the outer surface of the support sheet material.

Another feature of the present invention is to provide a surface mountable spotlight having a light directing housing provided with a rear flat mounting plate having a contour configuration which is coincident with the contour configuration of the light directing housing and wherein the light directing housing is angularly displaceable with respect to the rear flat mounting plate by an integrated hinge and rotatably displaceable by its mounting plate connection.

A still further feature of the present invention is to provide a surface mountable spotlight comprised of a light directing housing containing a light emitting diode source and wherein the housing is provided with a rear flat mounting plate provided with an electrical connector and retention means in combination with a junction box having at least one LED driver circuit and an outlet supply cable provided with a voltage supply cable having an end connector for removable connection to the electrical connector of the mounting plate and wherein the junction box is adapted to be connected to a voltage supply wire extending out of a mounting opening in a ceiling, wall or any convenient type surface sheet material and further wherein the junction box is configured to be inserted through the mounting opening for concealment behind the ceiling sheet material with the mounting plate retained flush on the outer surface of the ceiling sheet material and concealing the mounting opening.

Another feature of the present invention is to provide a surface mountable spotlight fixture comprised of a light housing detachably connectable to a flat rear mounting plate adapted to be detachably secured against an outer surface of a ceiling sheet material and about a mounting opening and wherein the light housing is a light transmitting lens flush mounted on the outer surface of the ceiling sheet material.

Another feature of the present invention is to provide a spotlight fixture which is not mounted on a connecting bar having a power supply for the spotlight and wherein there is no junction box making it light weight and capable of being fabricated from numerous materials, including glass and of different colors to provide a multitude of design features, and further wherein the spotlight is flush mounted with a support surface material.

According to the above features, from a broad aspect of the present invention there is provided a surface mountable spotlight comprised of a light directing housing having a rear mounting wall. A light emitting source is mounted in the light directing housing for emitting light out of the housing. The rear mounting wall has a contour configuration adapted to conceal a mounting opening formed in a support sheet material behind which is located an electrical connection to a power source. An electrical wire connector is provided on a rear surface of the rear mounting wall. Retention means is secured to the outer surface of the rear mounting wall and is adapted for removable attachment of the rear wall against an outer surface of the support sheet material. A junction box is adapted for connection to the power source and to the electrical wire connector to supply power to the light emitting source.

BRIEF DESCRIPTION OF THE DRAWINGS

A preferred embodiment of the present invention will now be described with reference to examples thereof as illustrated by the accompanying drawings in which.

DETAILED DESCRIPTION OF THE INVENTION

Figure 1:
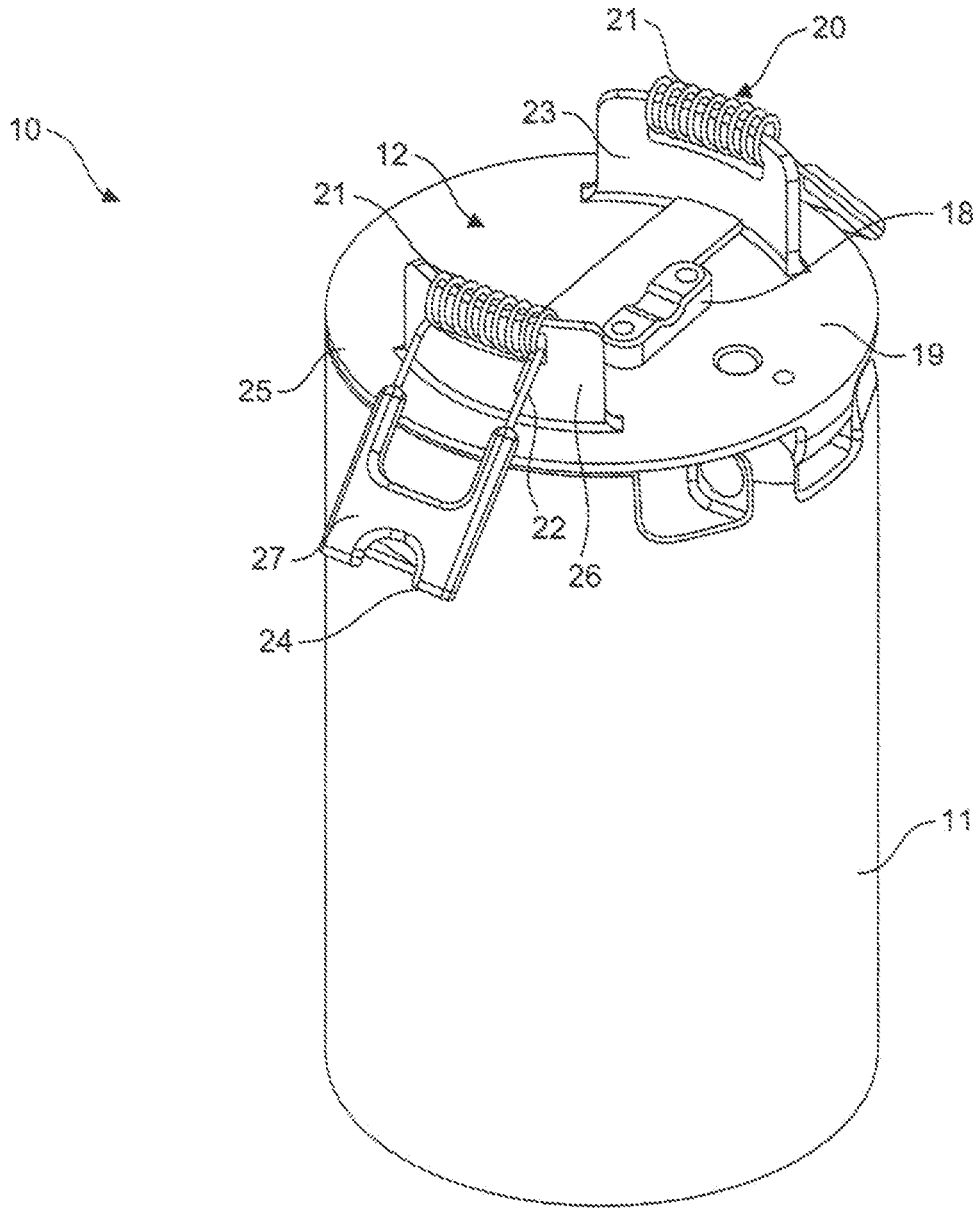
FIG. 1 is a perspective view of an embodiment of the surface mountable spotlight light directing housing of the present invention adapted for removable securement in a small mounting hole formed in a support sheet material.
Figure 2:
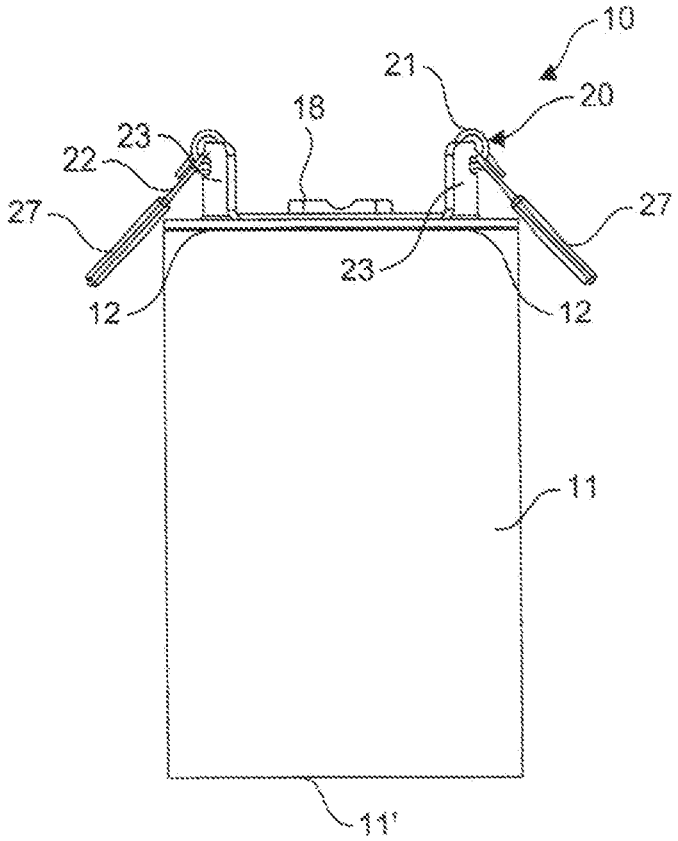
FIG. 2 is a side view of FIG. 1.
Figure 3:
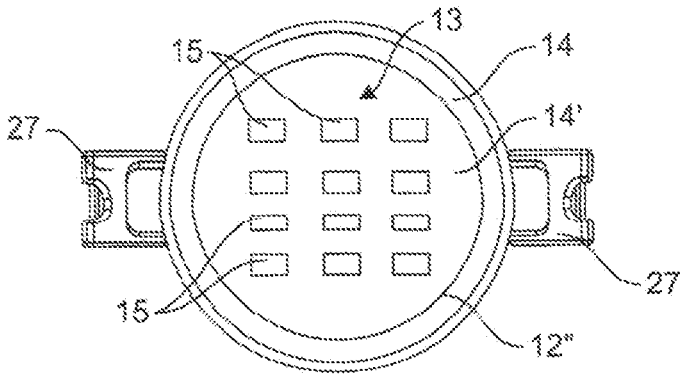
FIG. 3 is an end view showing the light source mounted inside the light directing housing at a rear inner end thereof.
Figure 4:
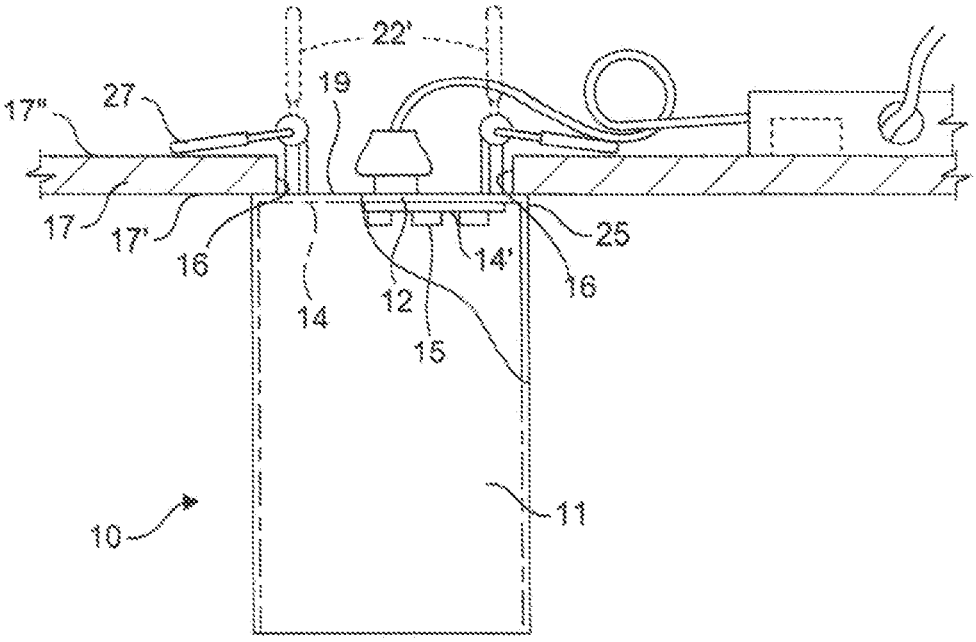
FIG. 4 is a fragmented view illustrating the securement attachment of the light directing housing about a mounting hole formed in a ceiling support sheet material.

Referring now to FIGS. 1 to 4, there is described the construction of the surface mountable spotlight 10 of the present invention. The surface mountable spotlight 10 is comprised of a light directing housing 11 having a rear mounting wall 12, which can also be a separate rear mounting plate 12, as herein illustrated, and which will be described later with reference to FIGS. 6 and 7, secured to the rear of the light directing housing 11. A light emitting source 13 is mounted on the rear wall inner surface 14, and has herein illustrated, is in the form of a plurality of light emitting diodes 15. The inner surface 14 of the rear wall may be a light reflecting surface 14'. The mounting plate has a contour configuration adapted to conceal a mounting opening 16 formed in a support sheet material 17, such has gypsum board sheet material commonly used in the construction of ceilings or walls behind which is located electrical wiring to a power source, as will be described later An electrical connector 18 is secured to an outer surface 19 of the rear mounting plate 12 and to which is connected wiring to the light emitting source, herein the diodes 15. The rear mounting plate 12 is further provided with retention means 20 secured to the rear outer surface 19 of the rear mounting plate 12 and which retention means is adapted for removable attachment of the rear mounting plate 12 against an outer surface 17' of the support sheet material 17 and covering the mounting opening 16, as shown in FIG. 4.

The retention means 20 as herein illustrated is comprised by a pair of spring members retained space-apart, herein on a diagonal side of the rear mounting plate 12. The spring members are comprised by a torsion helical spring section 21 and a clamping arm section 22 formed integral therewith. Each helical spring section 21 is retained on a respective one of attachment brackets 23 secured spaced-apart on the outer surface 19 of the rear mounting plate 12 with the clamping arm section 22 having a clamping end section 24 extending spring biased inwardly and beyond an outer edge 25 of the contour configuration of the rear mounting plate 12.

The clamping arm section 22 project forwardly of a front edge 26 of said mounting plate 12. The clamping arm section 22 is provided with a soft plastic pad covering 27 shaped to provide a smooth contact with the inner surface 17" of the support sheet material 17 not to damage the inner surface 17", and also provides for ease of displacement of the clamping arms for finger engagement and displacement thereof to a substantially vertical position, see 22' FIG. 4, as illustrated in phantom lines 22' in FIG. 4, to permit insertion within the mounting opening 16 in the support sheet material 17. Once the pair of clamping arm sections 22 are disposed slightly inserted in the opening 16, they are released and the light directing housing 11 is pushed upwards against the outer surface 17' of the support sheet material 17 with the spring arm sections spring biased inwards to engage on the inner surface 17" while exerting an inner pulling force for ease of insertion and to spring bias the outer surface 19 of the rear flat mounting plate 12 flush onto the outer surface 17' of the support sheet material 17.

It is pointed out that the circumferential shape of the rear flat mounting plate 12 is dimensioned to overlap the mounting opening to conceal the opening, as illustrated in FIG. 4. The light directing housing 11, as herein illustrated, is formed has a cylindrical housing having a circumferential shape coinciding with the contour configuration of the rear mounting plate 12. The housing 11 and the rear flat mounting plate 12 can have any circumferential shape, such as square, triangular, hexagonal, etc. The cylindrical housing 11 directs light emitted from the light emitting source 13 in a directional light beam out of the open end 11' of said cylindrical housing 11

Figure 5:
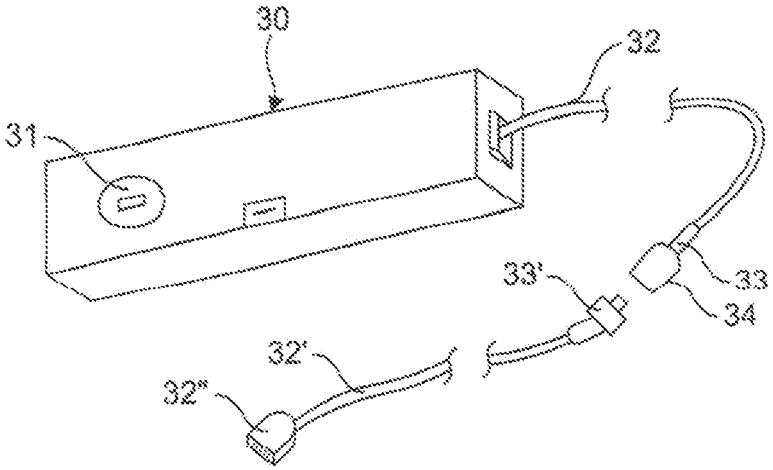
FIG. 5 is a perspective view of the junction box and its outlet electrical cable and connector adapted for securement to the electrical connector provided in the rear surface of the flat rear mounting wall or plate of the light directing housing.
Figure 9:
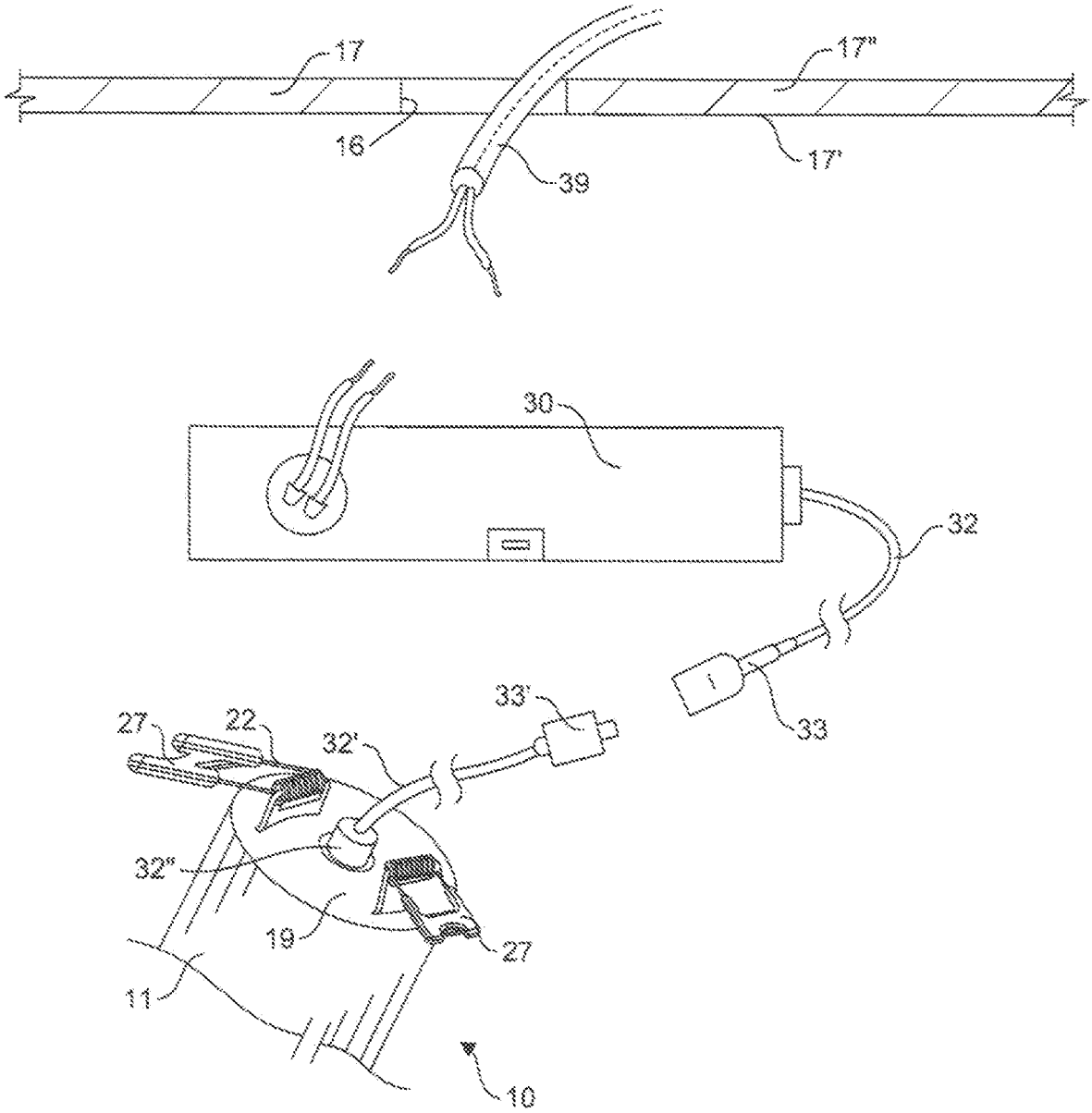
FIG. 9 is a simplified schematic illustrating an example of the mounting and securement of a plurality of surface mountable spotlights against a sheeting material mounting surface.
Figure 10:
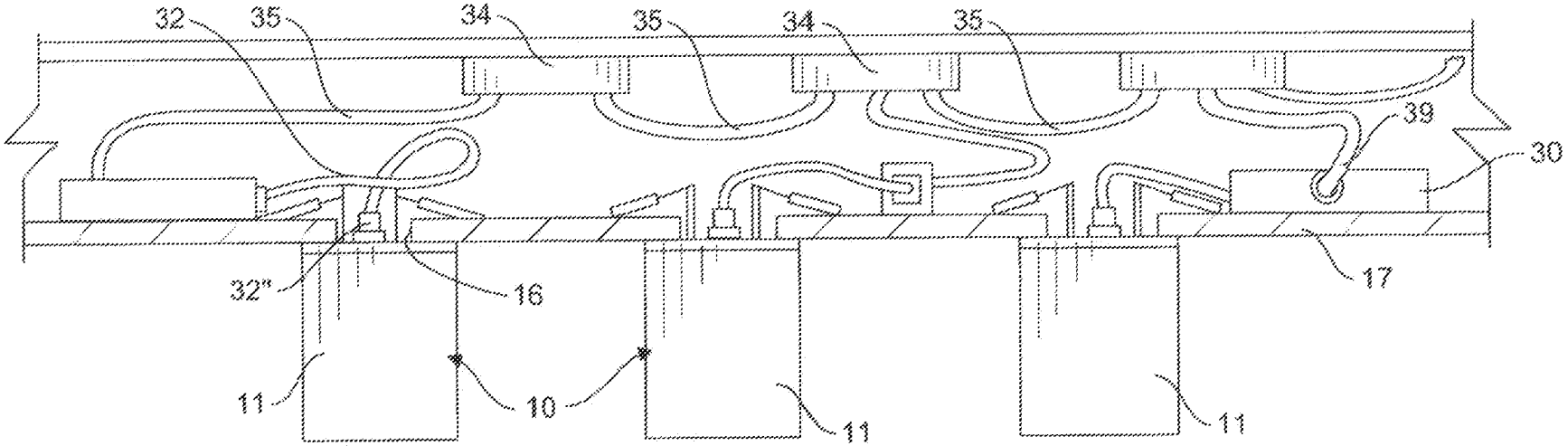
FIG. 10 is a further simplified schematic illustration of another example of the mounting of the surface mountable spotlight and wherein the junction box is configured for passage through a small mounting opening formed in the sheeting material.

Referring now additionally to FIGS. 5, 9 and 10 there will be described how the surface mountable spotlight 10 of the invention is supplied operating voltage and is mounted on the support sheet material 17 to form a trackless spotlight mounting system. Because the spotlight housing is a relatively small and light weight light fixture and mounted directly against a support sheet material, such as a ceiling sheeting material, only a small mounting hole needs to be made in the ceiling sheeting material whereby to be concealed by the rear mounting plate 12, as shown in FIG. 4. Several mounting arrangements are foreseen, and as shown in FIG. 9, with new ceiling construction, a standard 120 volts supply wire 39 is installed to exit the mounting opening 16 or several mounting opening disposed in a predetermined arrangement, and the connection to a junction box needs to be made outside the mounting opening 16. To provide for such mounting arrangement, the junction box 30, as shown in FIG. 5, is formed as an elongated rectangular housing having a circumference smaller than the mounting opening 16. A detachable knock-out 31 permits access to internal wire connections (not shown but obvious to a person skilled in the art). An outlet supply cable 32, containing the voltage supply wires to operate the light source, exits the junction box 30. In this particular embodiment the light source is comprised of LED's and therefore the junction box also contains an ac/dc converter and a driver circuit (not shown but obvious) to supply the drive current to operate the LED's mounted within the spotlight fixture. The outlet cable 32 is provided with an end connector 33 adapted for quick connection with a connector 33' of an extension cable 32' having an end connector 32" for removable connection with the electrical connector 18 mounted on the outer surface 19 of the rear mounting plate 12 to provide quick connection. Once the connection is made, the junction box 30 is pushed into the opening and lies concealed on the rear surface 17" of the ceiling sheeting material 17 and the rear mounting plate is installed as above described. It is pointed out that the cable 32 may be of sufficient length and fitted with the end connector 32" for connection to the electrical connector 18 of the spotlight 10.

FIG. 10 illustrates another arrangement for a new ceiling or wall construction where a junction boxes 30 are pre-installed and wired to fixed standard junction boxes 34 and wiring 35 before the ceiling sheeting material 17 is installed and in such mounting arrangement only the outlet cables 32 of the junction box which can be of any size or shape, exit the mounting openings 16. The outlet cable 32 from the junction boxes 30 are herein illustrated as being of sufficient length and are provided with a connection plug 32" adapted for quick connection to the electrical connector 18 of the fixture. It can be noted that in all of these mounting arrangements, it is possible to change the spotlight 10 by simply pulling it out of its mounting opening 16 and detaching the connector from its rear electrical connector 18 and easily replacing the fixture with a new or different one.

Figure 7:
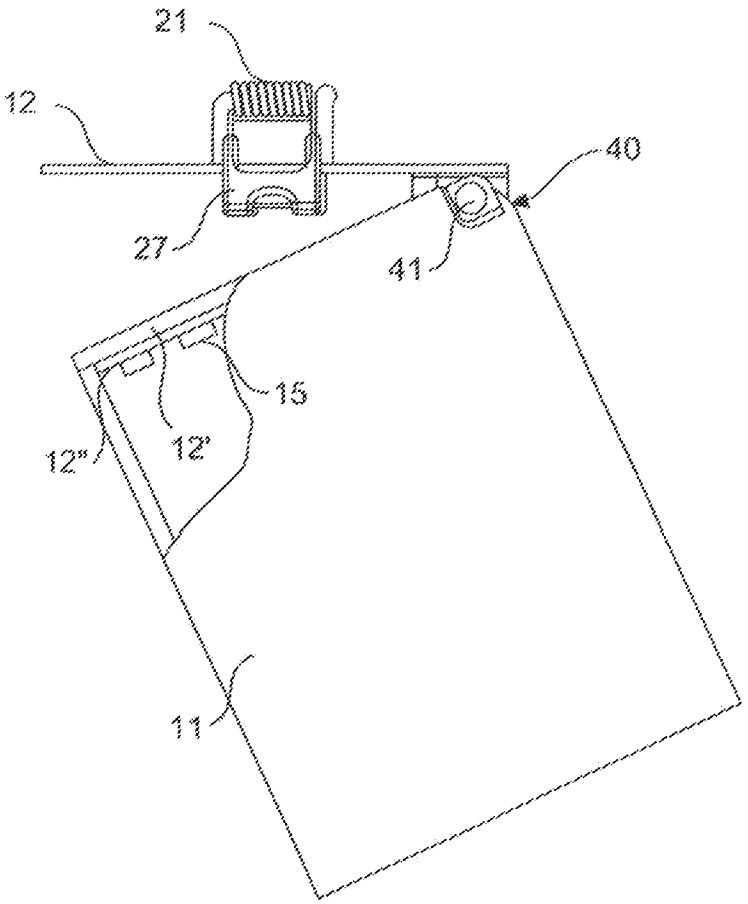
FIG. 7 is a side view of FIG. 6.
Figure 6:
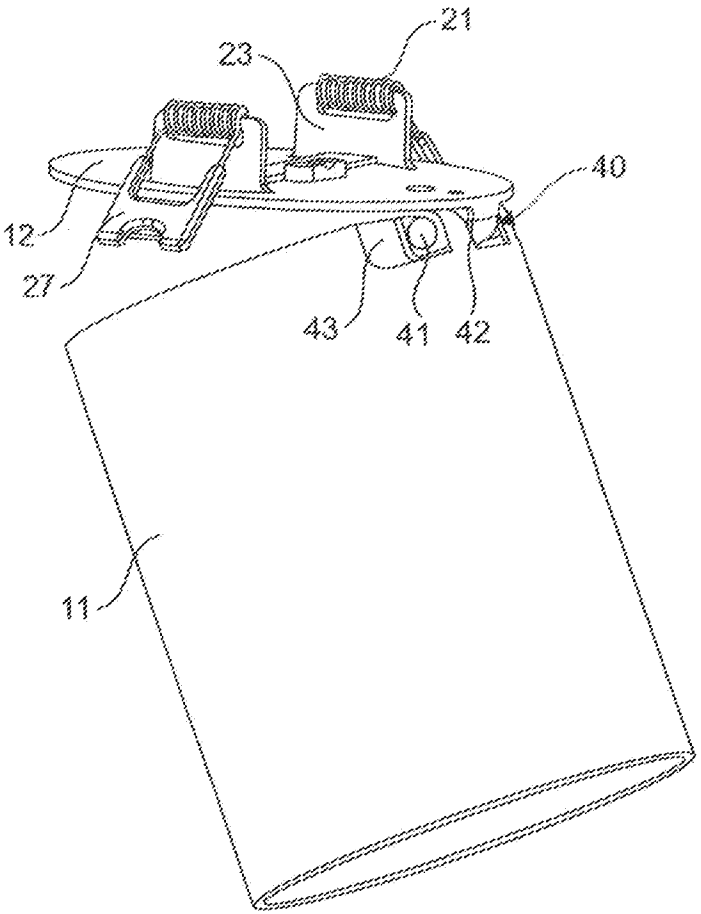
FIG. 6 is a perspective view showing a modification of the light directing housing construction wherein the flat rear mounting plate is secured to the cylindrical housing by a hinge connection.

FIGS. 6 and 7 illustrates a further example of the construction of the surface mountable spotlight 10 wherein the cylindrical housing 11 is secured to the rear mounting plate 12 by a hinge connection 40 to position and retain the cylindrical housing at angle with respect to the rear mounting plate 12 and the outer surface 17' of the support sheet material 17 to orient the angular direction of the light beam. In this embodiment the housing has a rear wall 12' with the diodes 15 mounted on a reflector plate 12" secured to its inner surface. The hinge connection is a recessed friction hinge, hardly noticeable, and wherein the hinge pin 41 is in tight friction fit within a hole provided in a connection flange 42 defined by opposed recesses 43 machined or molded into a top area of the cylindrical housing whereby to retain the housing at a desired angle with respect to the mounting plate 12. To orient the light beam circumferentially, it is only necessary to rotate the cylindrical housing 11 causing the pad formations 27 to slide on the rear surface 17" of the sheeting material 17 due to its pad covering material.

Figure 8:
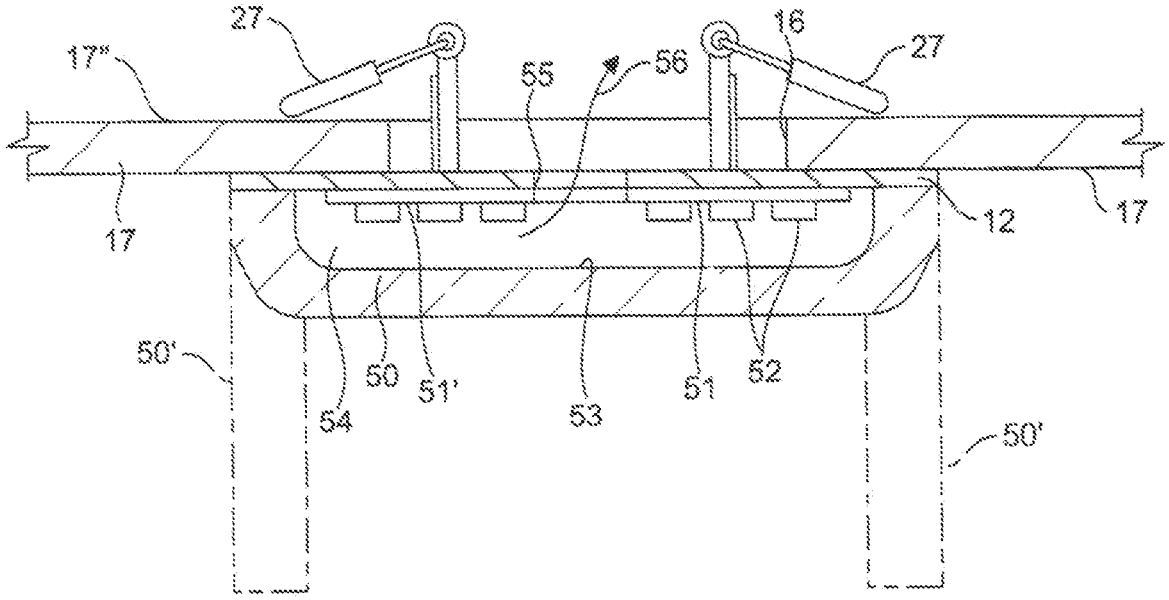
FIG. 8 is a side view of a further example of the construction of the surface mountable spotlight wherein the light directing housing is provided by a detachable lens of light transmitting material which is permanently attached to the flat rear mounting plate wherein the lens is retained flat against the outer surface of the sheeting material.

Referring now to FIG. 8, there is illustrated a further modification of the surface mountable spotlight wherein the light directing housing is constituted by a solid light transmitting lens 50 secured to the rear mounting plate 12. Instead of a lens a globe of suitable shape can be secured to the mounting plate 12. The securement of the lens or globe can be of a permanent nature by the use of glue or other permanent attachment means or a removable securement by the use of clamps, screw threads, etc. The lens can be opaque on its side surface and clear in an end area where a light beam is desired to be projected. The lens can also be a colored glass lens for decorative purposes and may have a cylindrical shape as shown in phantom lines 50'. The rear mounting plate 12 has an outer LED mounting surface 51 which may have a reflective coating 51' and on which light emitting diodes 52 are mounted. The solid lens 50 has a rear surface 53 spaced forwardly of the light emitting diodes to form a vent space 54. One or more vent passages 55 are formed in the mounting plate 12 for conducting heat out of the vent space 54, as illustrated by arrow 56.

It is within the ambit of the present invention to cover any obvious modifications of the examples of the preferred embodiment described herein provided such modifications fall within the scope of the appended claims.

The invention claimed is:

1. A surface mountable spotlight comprising:

a light directing housing having a rear Mounting wall, a light emitting source in said light directing housing for emitting light out of said housing, said rear mounting wall having a contour configuration adapted to conceal a mounting opening formed in a support sheet material behind which is located an electrical connection to a power source, an electrical connector in a rear, surface of said rear mounting wall, retention means secured to said rear surface of said rear mounting wall adapted for removable attachment of said rear mounting wall against an outer surface of said support sheet material, and a junction box adapted for connection to said power source and having an electrical cable to connect to said electrical connector to supply power to said light emitting source.

2. The surface mountable spotlight as claimed in claim 1 wherein said rear mounting wall is a rear mounting plate.

3. The surface mountable spotlight as claimed in claim 2 wherein said junction box is dimensioned for passage through said mounting opening to permit positioning said junction box concealed from view behind said support sheet material.

4. The surface mountable spotlight as claimed in claim 2 wherein said an outlet electrical cable of said junction box is provided with an outlet connector, said outlet electrical cable and being of sufficient length to permit connection to said electrical connector in said rear surface of said mounting plate from outside said mounting opening.

5. The surface mountable spotlight as claimed in claim 4 wherein said function box is provided with an outlet supply cable having a connector at a free end thereof said outlet electrical cable being secured to said connector at said free end of said supply cable, said junction box being mounted concealed behind said support sheet material.

6. The surface mountable spotlight: as claimed in claim 2 wherein said retention means is comprised by a pair of spring members secured to attachment brackets, each spring member of said pair of spring members having a torsion helical spring section and a clamping arm section, each said helical spring section being secured to a respective one of said attachment brackets secured spaced-apart on said rear surface of said rear mounting plate with said clamping arm section having a clamping end section extending spring biased inwardly and beyond an outer edge of said contour configuration of said rear mounting plate and projecting forwardly of a front surface of said Mounting plate, said Clamping arm section of said pair of clamping members being adapted to engage a rear surface of said support sheet material to apply a retention force of an outer contour area of said rear surface of said rear mounting plated about said outer surface of said support sheet material about said mounting opening.

7. The surface mountable spotlight as claimed in claim 6 wherein said clamping arm sections of said helical coil spring are displaceable inwardly above said rear surface of said rear mounting plate against said biasing force to permit entry thereof through said mounting opening.

8. The surface mountable spotlight as claimed in claim 2 wherein said light directing housing is formed by a cylindrical housing having a circumferential shape coinciding with said contour configuration of said rear mounting plate, said cylindrical housing directing light emitted from said light emitting source in a directional light beam out of an open end of said cylindrical housing.

9. The surface mountable spotlight as claimed in claim 8 wherein said cylindrical housing is secured to said rear mounting plate by a hinge connection secured in a top peripheral edge of said cylindrical housing and connected to an outer edge of said rear mounting plate whereby to position and retain said cylindrical housing at an angle with respect to said rear mounting plate and said outer surface of said support sheet Material to orient the angular direction of said light beam.

10. The surface mountable spotlight as claimed in claim 2 wherein said light directing housing is constituted by a light transmitting lens having a connector structure for enabling releasable connection to said rear mounting plate, said rear mounting plate having an outer LED mounting surface, said light emitting source being constituted by light emitting diodes (LED's) being mounted on said mounting surface, said lens having a rear surface spaced forwardly of said light emitting diodes to form a vent space, and one or more vent passages for conducting heat out of said vent space.

11. The surface mountable spotlight as claimed in claim 10 wherein said junction box has an outlet electrical cable provided with an outlet connector and being of sufficient length and adapted for connection to said wire connector in said rear surface of said mounting plate from outside said mounting opening.

12. The surface mountable spotlight as claimed in claim 10 wherein said mounting surface is a light reflecting surface.

13. The surface mountable spotlight as claimed in claim 10 wherein said one or more vent passages are formed in said rear mounting plate and said light reflecting surface for conducting heat out of said vent space.

14. The surface mountable spotlight as claimed in claim 10 wherein said junction box is dimensioned for passage through said mounting opening to permit positioning said junction box concealed from view behind said support sheet material.

15. The surface mountable spotlight as claimed in claim 1 wherein said light emitting source is a light emitting diode source, a voltage supply cable accessible through said mounting opening, said voltage supply cable being connected to said junction box having at least one driver circuit to provide for the operation of said light emitting diode source, said junction box having an outlet cable provided with a connector for connection to said wire connector in said rear surface of said rear mounting wall, said junction box being dimensioned for passage through said mounting opening to locate said junction box on an inner surface of said support sheet material.

16. The surface mountable spotlight as claimed in claim 1 wherein said light emitting source is a light emitting diode source, said junction box having an outlet cable provided with a connector connected to said wire connector in said rear surface of said rear mounting plate, said junction box having at least one driver circuit to provide for the operation of said light emitting diode source, said junction box being connected to a voltage supply source, said junction box being dimensioned for passage through said mounting opening to locate said junction box on an inner surface of said support sheet material and wherein said rear mounting plate can be retained against said outer surface of said support sheet material by said retention means, said support sheet material being that of a ceiling sheet material.

* * * * *